US006152801A

United States Patent [19]

Tsai

[11] Patent Number: 6,152,801

[45] Date of Patent: Nov. 28, 2000

[54] TOY CAR STRUCTURE

[76] Inventor: Wen-Ho Tsai, 8F. No. 113, Yu-Jen Rd., Peitou Dist., Taipei, Taiwan

[21] Appl. No.: 09/348,168

[22] Filed: Jul. 7, 1999

[51] Int. Cl.[7] ..... A63H 17/273; A63H 17/28

[52] U.S. Cl. ..... 446/470; 446/431; 446/437

[58] Field of Search ..... 446/470, 471, 446/456, 6, 289, 431, 437

[56] References Cited

U.S. PATENT DOCUMENTS

| | | | |
|---|---|---|---|
| 4,542,872 | 9/1985 | Tsai | 446/440 |
| 4,762,511 | 8/1988 | Lee et al. | 446/6 |
| 4,925,427 | 5/1990 | Wu | 446/409 |
| 5,069,649 | 12/1991 | Wu | 446/288 |
| 5,360,367 | 11/1994 | Tsai | 446/470 |
| 5,580,296 | 12/1996 | Chow | 446/443 |
| 5,735,727 | 4/1998 | Tsai | 446/462 |
| 5,807,158 | 9/1998 | Tsai | 446/470 |
| 6,000,988 | 12/1999 | Tsai | 446/231 |

*Primary Examiner*—Jacob K. Ackun
*Assistant Examiner*—Kevin Hughes
*Attorney, Agent, or Firm*—Dougherty & Troxell

[57] ABSTRACT

A toy car structure in which a power source such as a motor is activated to drive a gear set for driving decorative car doors, engine hood and car light cover bodies of a car body to open or close so as to create versatile operation.

5 Claims, 9 Drawing Sheets

TOY CAR STRUCTURE

BACKGROUND OF THE INVENTION

The present invention relates to a toy car structure, and more particularly to a transmission mechanism of a toy car, which is able to drive multiple operation elements to open or close during running of the car body so as to create versatile operation.

A conventional toy car is designed with attractive appearance and simple operation (such as running of the car body and sound/light effect) for achieving entertaining effect. However, the transmission mechanism of such toy car is unable to create versatile operations so that the conventional toy car can hardly satisfy the requirement of children. In order to solve this problem, some toy cars are designed with a transmission mechanism which is able to create versatile operations. However, such transmission mechanism is quite complicated so that the cost for the toy car is relatively high and the malfunction possibility of the toy car is increased.

SUMMARY OF THE INVENTION

It is therefore a primary object of the present invention to provide a toy car which is manufactured at low cost, while able to create versatile operations.

The present invention can be best understood through the following description and accompanying drawings wherein:

DETAILED DESCRIPTION OF THE PREFERRED EMBODIMENT

Figure 1:
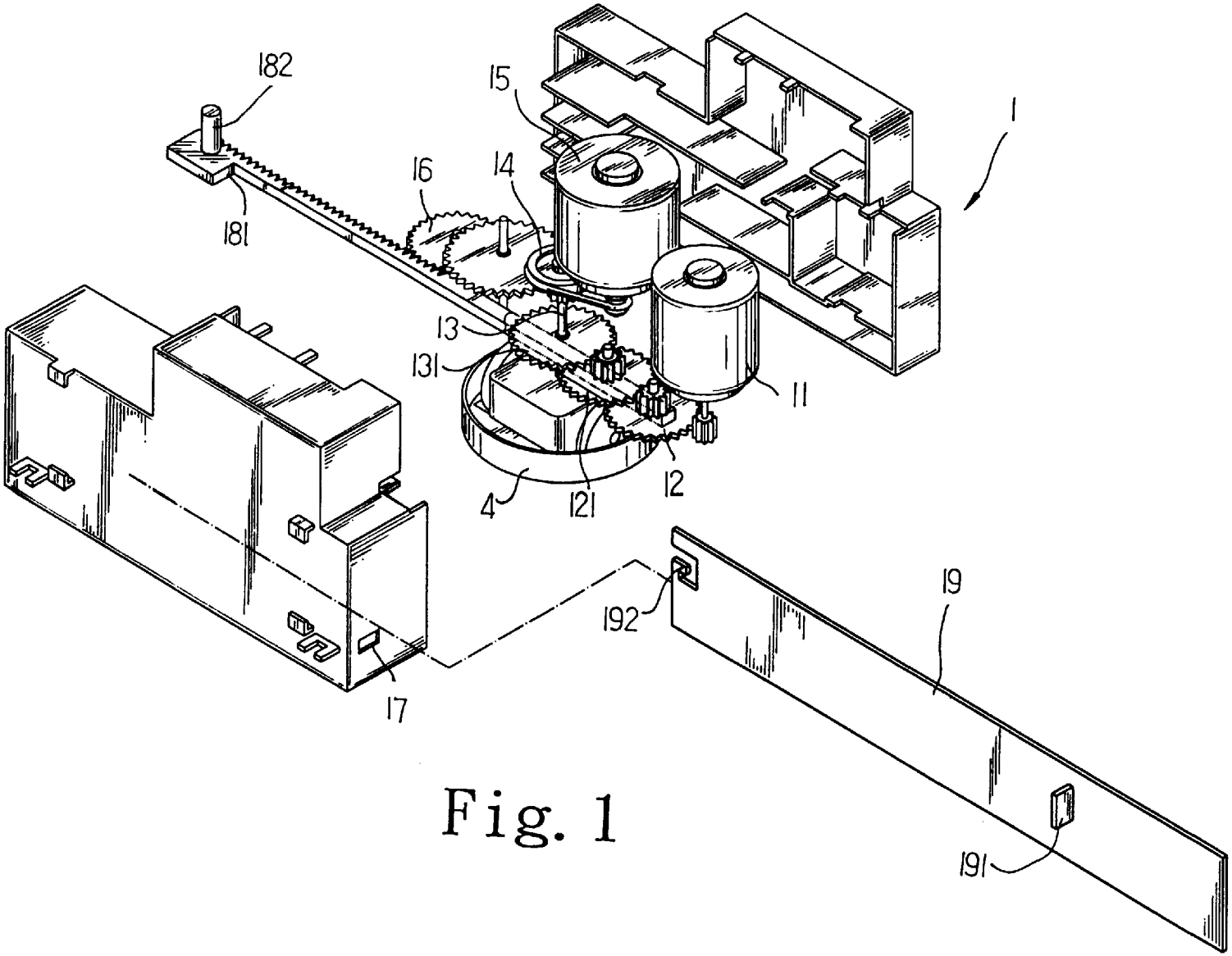
FIG. 1 is a perspective exploded view of the casing of the present invention.
Figure 2:
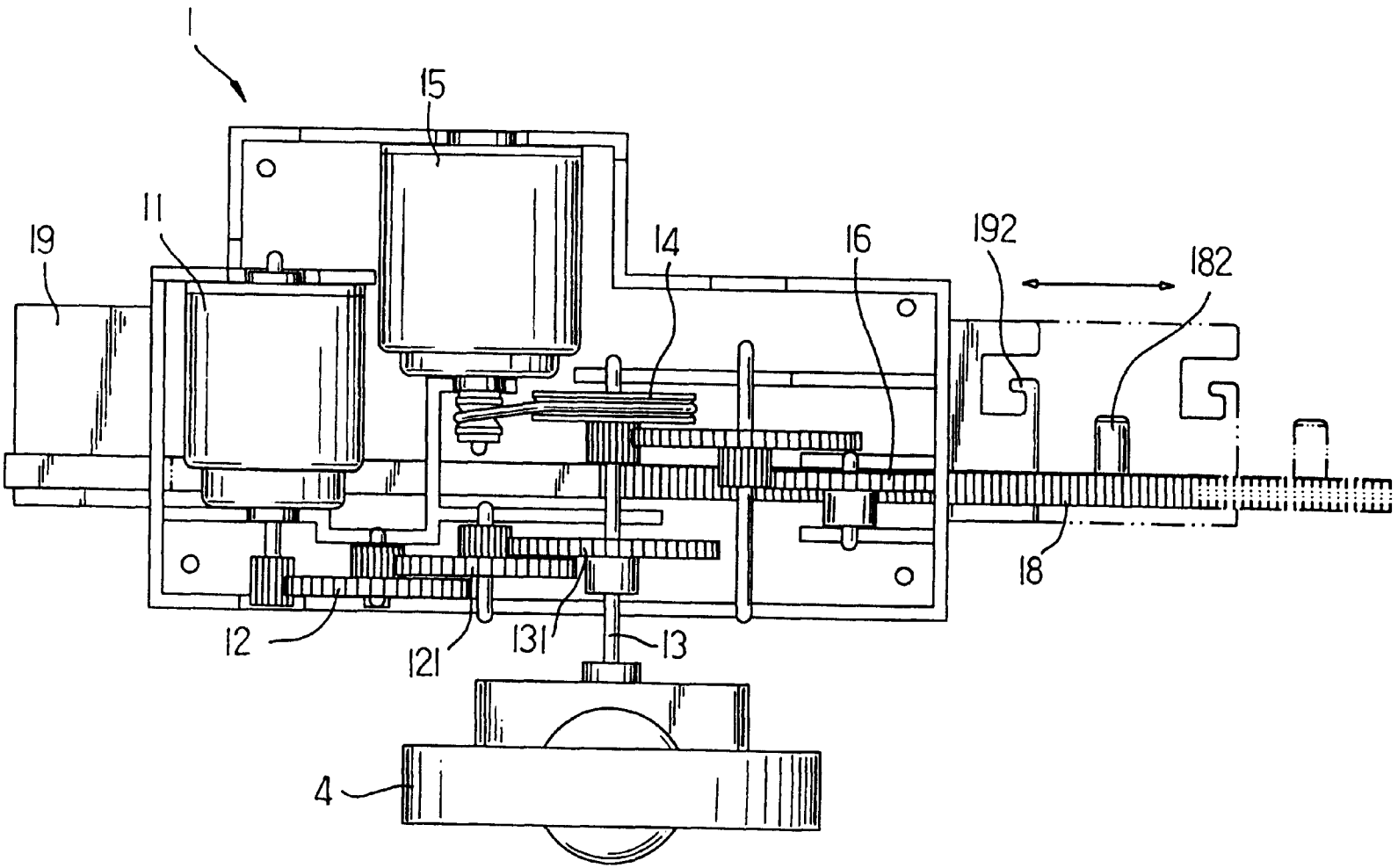
FIG. 2 is a plane assembled view of the casing of the present invention.

Please refer to FIGS. 1 and 2. A base seat 3 is disposed on the bottom of a car body 2. A casing 1 is mounted on the base seat 3. A first power source 11 such as a motor is disposed in the casing 1. The first power source 11 via a gear set 12 is drivingly connected with a vertical connecting rotary shaft 12. The bottom end of the rotary shaft 12 extends out of the casing 1 and the car body 2 and connected with a rotary power wheel set 4. Both a transmission gear 131 is fixedly fitted, and a driving wheel 14 is loosely fitted onto the rotary shaft 13 transmission gear 131 meshes with a connecting gear 121. The driving wheel 14 is driven by a second power source 15 to drive a driving gear 16. Two ends of one side of the casing 1 are respectively formed with perforations 17 between which a transverse rack 18 is bridged. The rack 18 is drivingly engaged with the driving gear 16. One end section of the rack 18 is formed with a pushing edge 181 and disposed with an upward extending post 182. The pushing edge 181 serves to drive a driving block 19 disposed outside the casing 1. The driving block 19 is disposed with a pushing projection 191 and a hook section 192 at rear end. Via a resilient member 193, the hook section 192 is hooked on the base seat 3.

Figure 3:
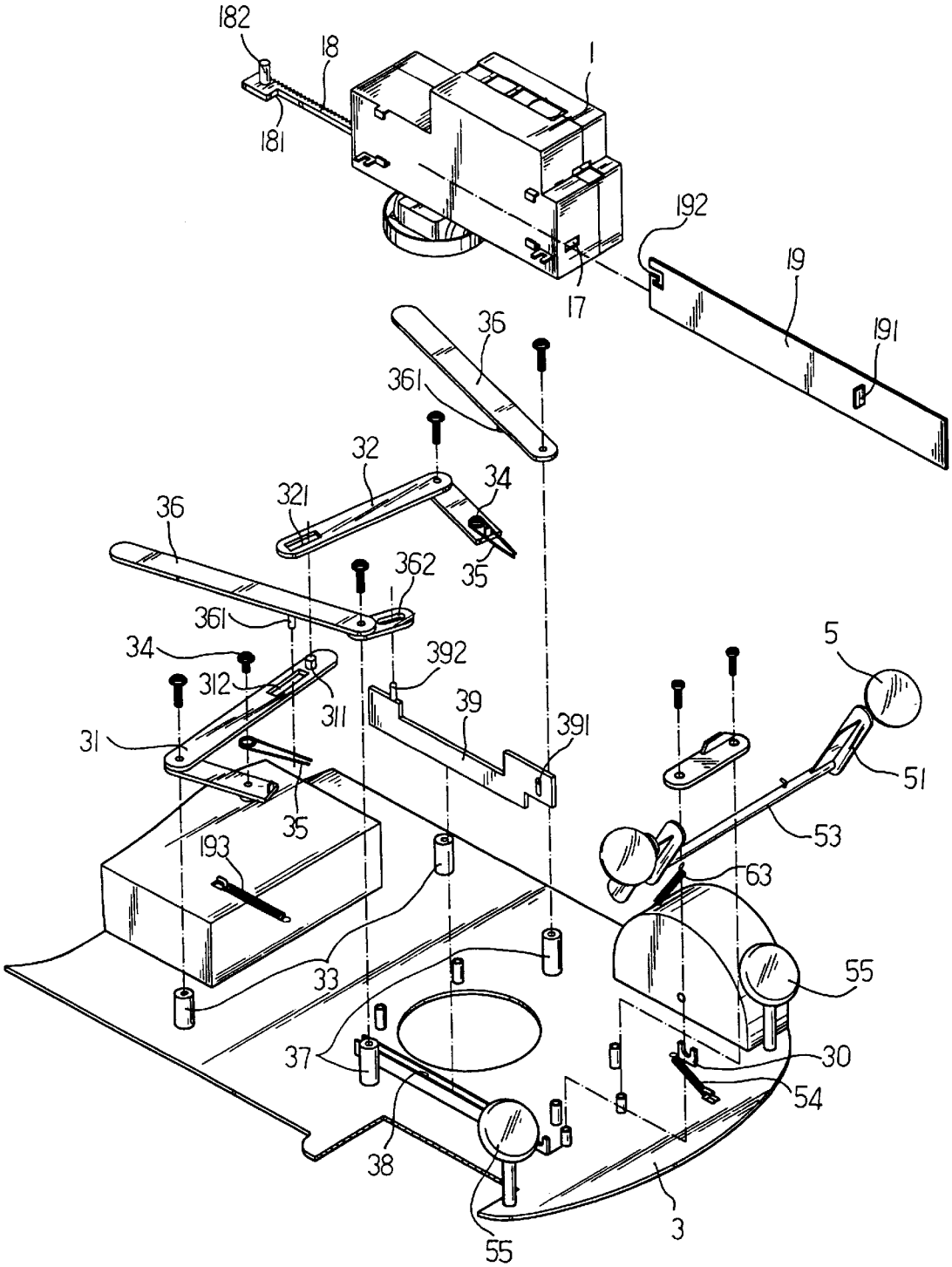
FIG. 3 is a perspective exploded view of the present invention.
Figure 4:
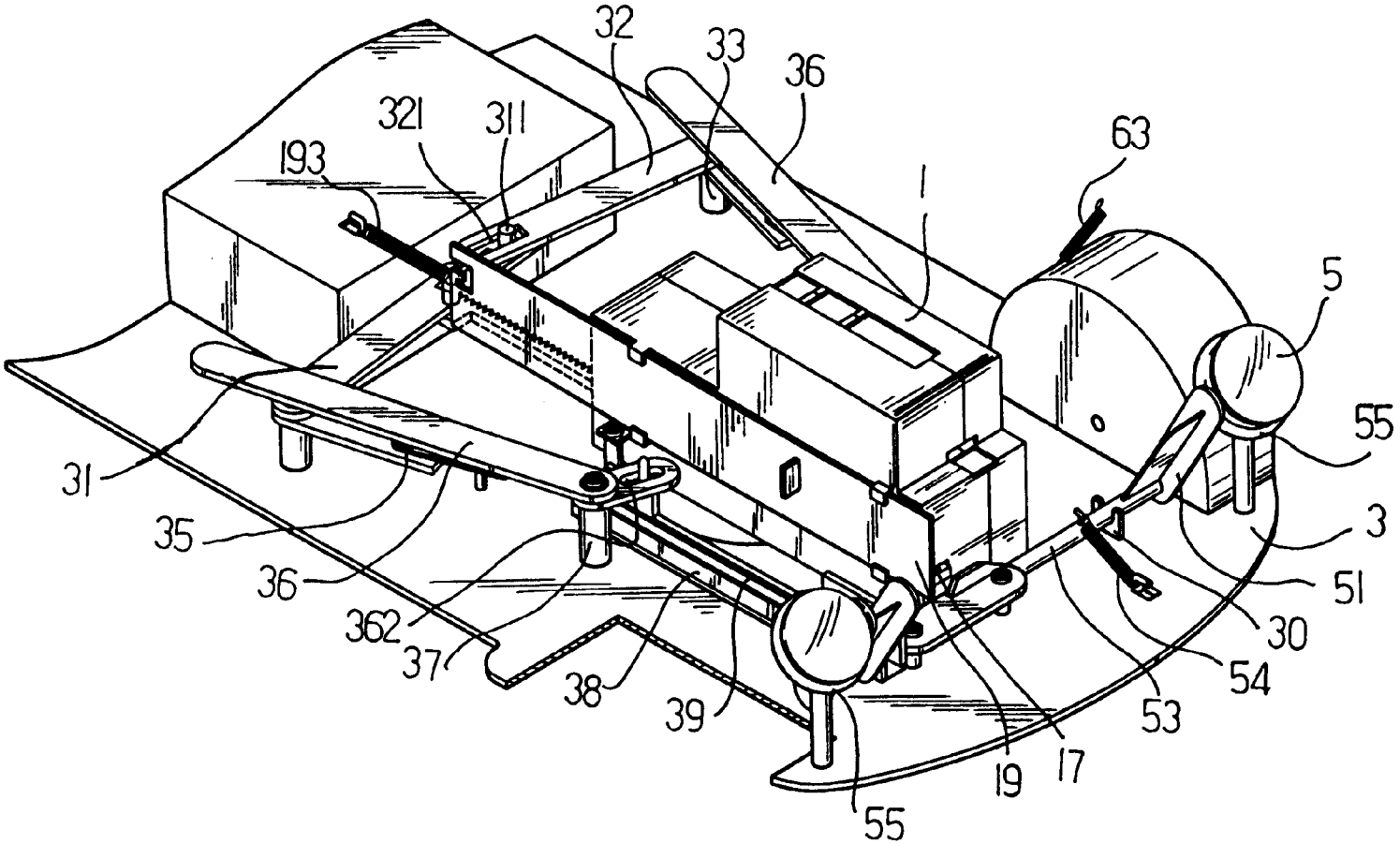
FIG. 4 is a perspective assembled view of the present invention.
Figure 5:
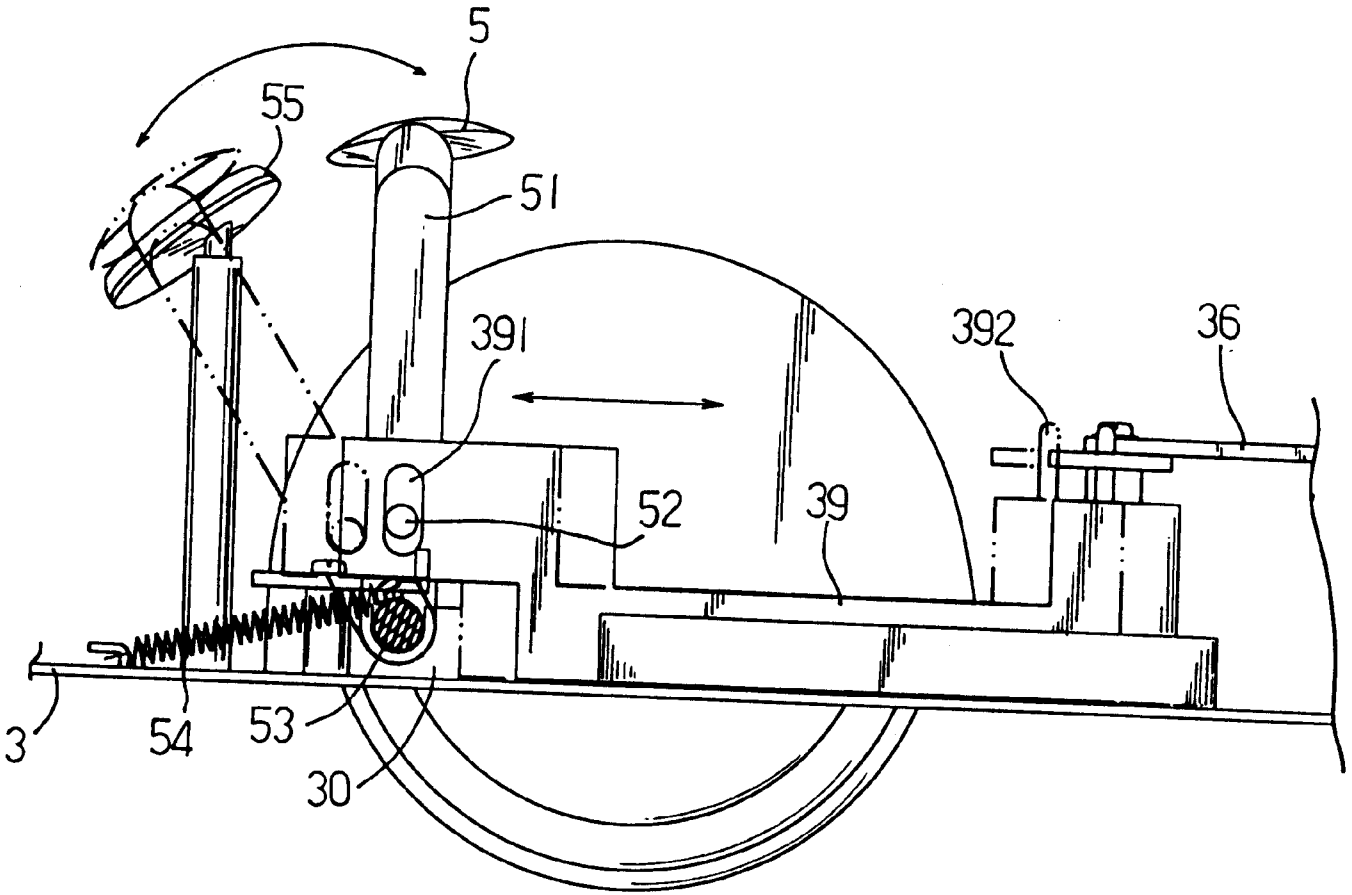
FIG. 5 shows the operation of the car light cover body of the present invention.
Figure 6:
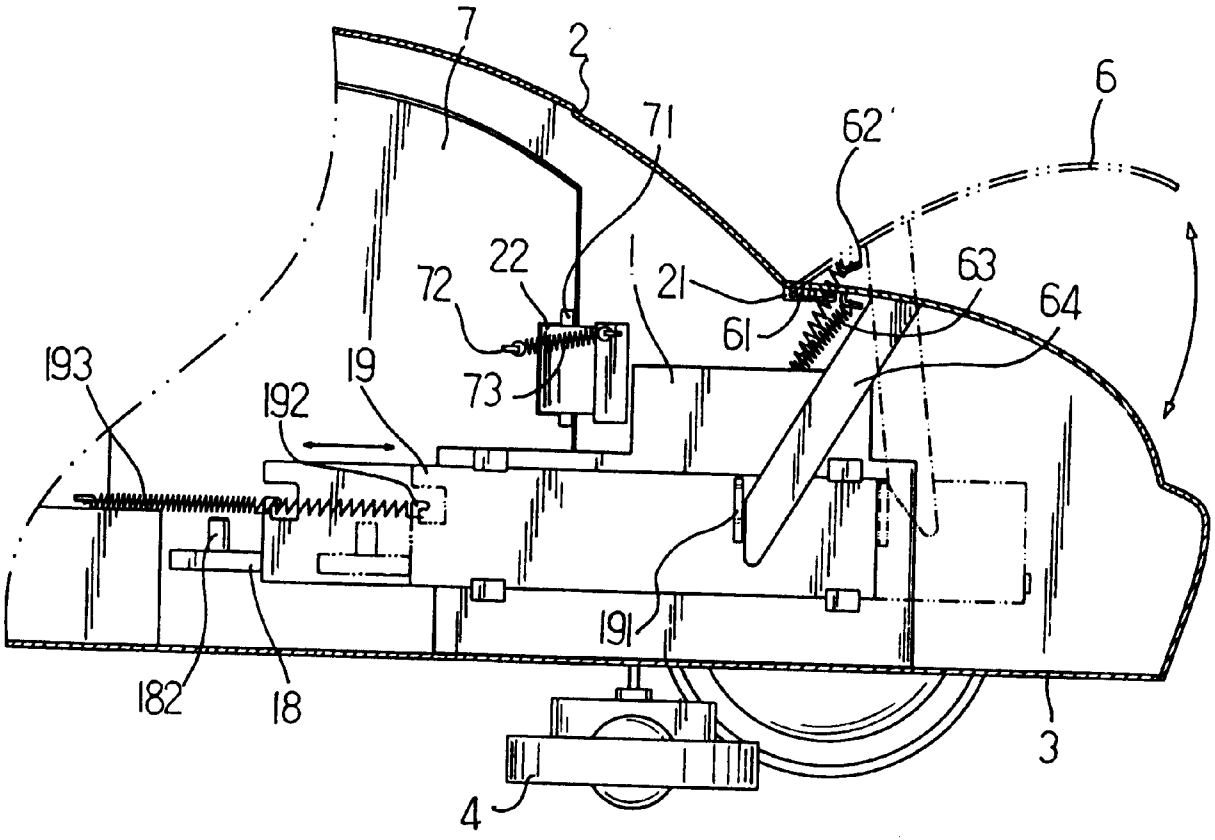
FIG. 6 shows the operation of the engine hood of the present invention.
Figure 7:
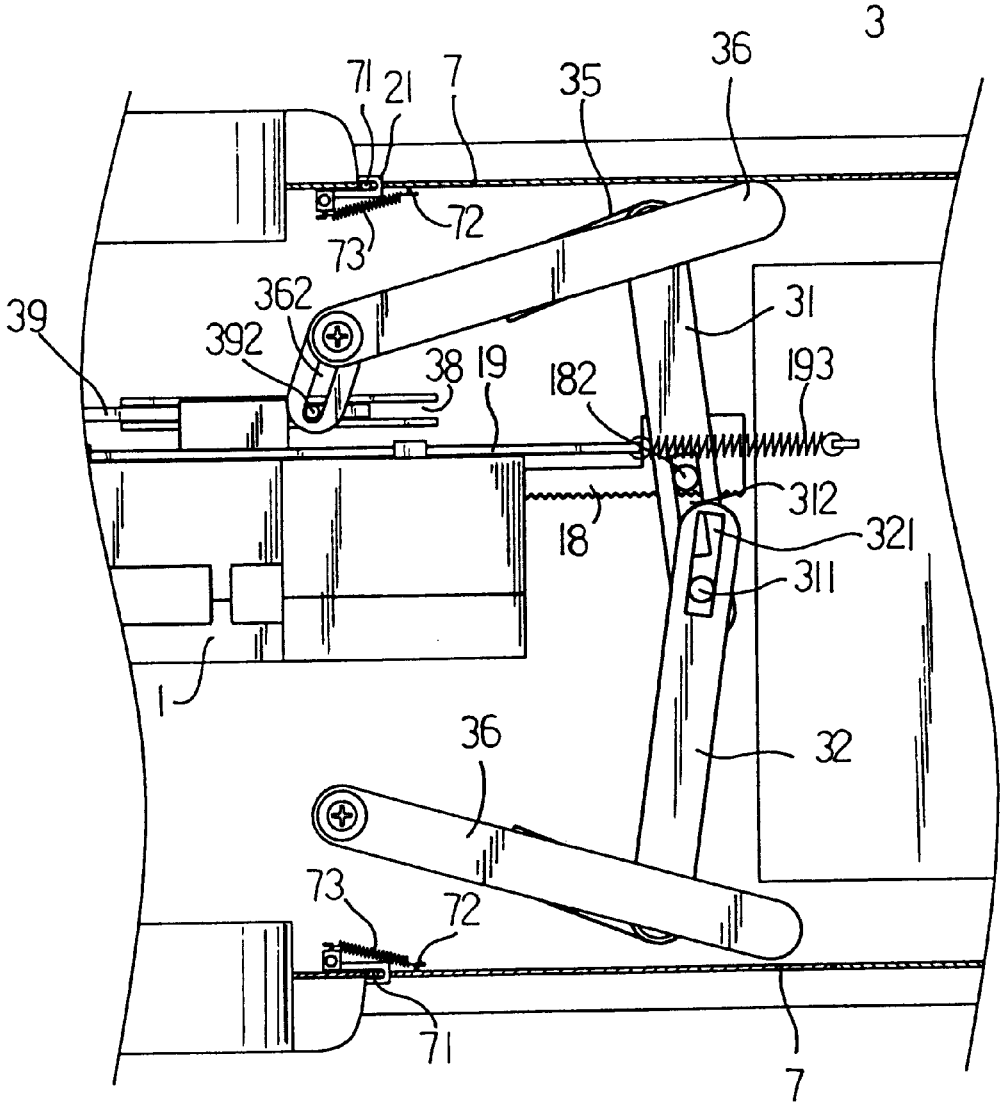
FIG. 7 shows that the car doors of the present invention are not operated.
Figure 8:
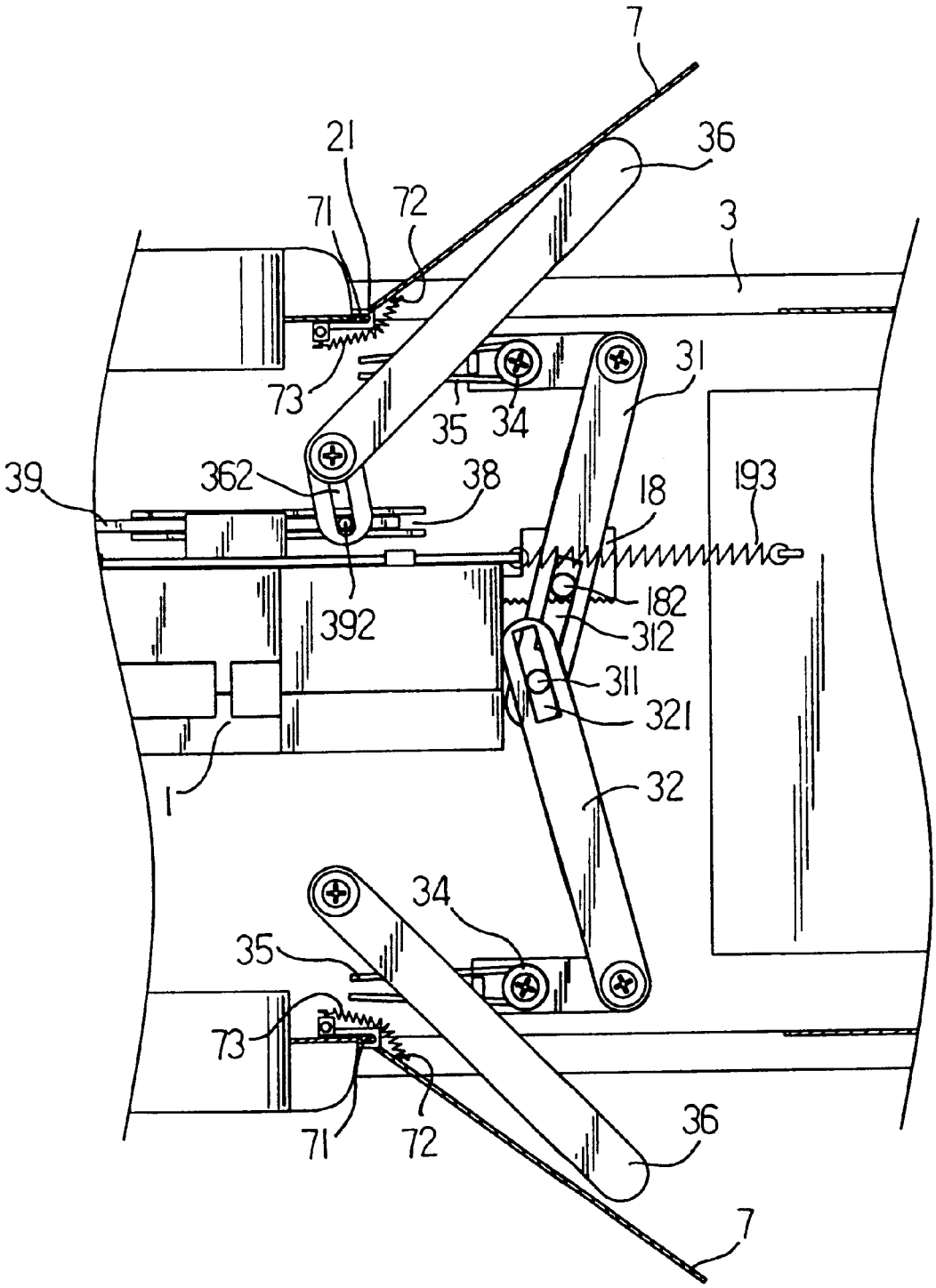
FIG. 8 shows that the car doors of the present invention are operated and opened.
Figure 9:
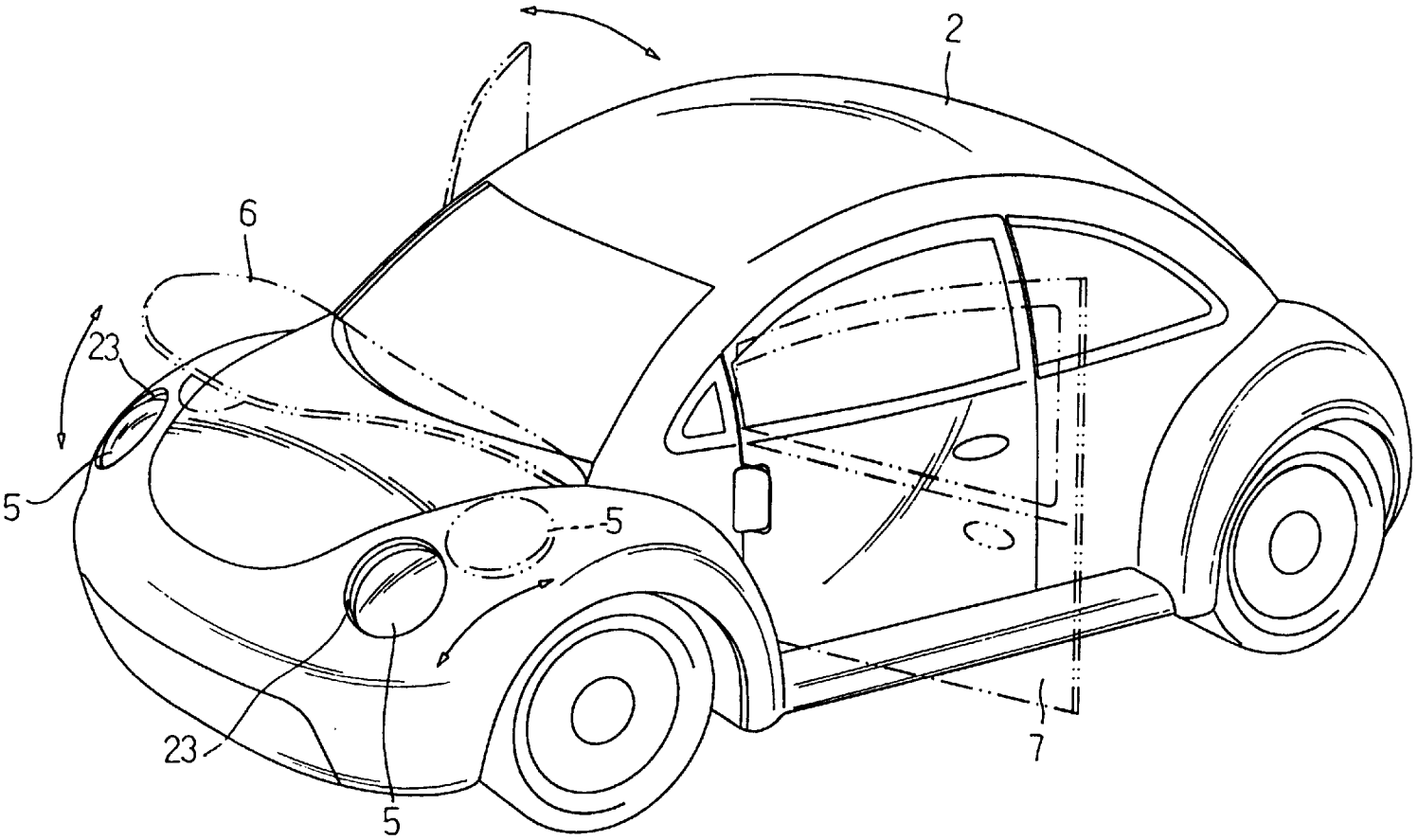
FIG. 9 is a perspective view showing the appearance of an embodiment of the present invention.

Referring to FIGS. 3 and 4, the base seat 3 is disposed with a first and a second linking members 31, 32 on two sides of an end section of the casing 1. Each of the first and second linking members 31, 31 has a longer arm and a shorter arm and are mounted at junctures on 33 of the base seat 3 as fulcrums. The end section of the longer arm of the first linking member 31 is disposed with a post 311 and a slot 312 adjacent to the post 311. The post 182 of the end section of the rack 18 extends into the slot 312 to drive the first linking member 31 back and forth. The end section of the longer arm of the second linking member 32 is formed with a slot 321. The post 311 of the first linking member 31 extends into the slot 321 to drive the second linking member. The shorter arm of each of the linking members 31, 32 via a fixing member 34 is connected with a resilient linking member 35. An end section of the resilient linking member 35 clamps a post 361 of a pushing member 36 disposed on the support posts 37 on two sides of the casing 1. At least one pushing member 36 is disposed with an extending short arm formed with a slot 362. The base seat 3 is formed with a guide slot 38 below the slot 362. A guide member 39 is received in the guide slot 38. One end of the guide member 39 is formed with a perforation 391. The other end thereof is disposed with an upward extending post 392 extending into the slot 362.

At least one decorative car light cover body 5 is disposed with a downward extending driving arm 51. The bottom end of the driving arm 51 is connected with a beam 53 and connected on the base seat 3 with a fixing seat 30 of the base seat 3 as a fulcrum. The driving arm 51 is disposed with a driving post 52 extending into the perforation 391 of the guide member 39 to be driven thereby to upward move and open or downward move and close the car light cover body 5. The post 52 is disposed with a hook which via a resilient member 54 is hooked on the base seat 3. The base seat 3 is disposed with a decorative car light 55 corresponding to the car light cover body 5. The car body 2 is formed with a through hole 23 corresponding to the car light 55.

Each end section of a decorative engine hood 6 is disposed with a projection which serves as a fulcrum 61 and extends into the fixing socket 21 of the car body 2. The hood 6 is disposed with a hook 62 which via a resilient member 63 is hooked on the base seat 3. The hood 6 is disposed with a downward extending pushing member 64 pushed by the pushing projection 191 of the driving block 19. When the driving block 19 is moved back and forth, the engine hood 6 is driven upward and open or downward and closed.

One side of a decorative car door 7 is disposed with a pivot shaft 71 which serves as a fulcrum and is disposed in a pivot seat 22 of the car body 2. A hook 72 is disposed on the car door 7 near the pivot shaft 71, which via a resilient member 73 is hooked on the car body 2. When the first and second linking members 31, 32 operate, the pushing member 36 is driven to push the car door 7 to move forward and open or move backward and close.

According to the above arrangement, after the first power source 11 is turned on, the gear set 12 is driven to continuously drive the connecting gear 121 for driving the rotary shaft 13 to rotate. At this time, the rotary power wheel set 4 is driven and the toy car can run over when touching the ground. Also, the second power source 15 in the casing 1 drives the driving gear 16 to move the rack 18 back and forth so as to drive the first and second linking members 31, 32 on the casing 1 to swing back and forth. At this time, the pushing member 36 is driven to push outward the car door 7 and open the car door. Also, the pushing member 36 drives the guide member 39 so as to drive the car light cover body 5 up and down and open and close. In addition, when the rack 18 drives the first and second linking members 31, 32, the driving block 19 is also driven to slide back and forth. At this time, the pushing edge 191 of the driving block 19 pushes the pushing member 64 of the engine hood 6 so as to open and close the engine hood 6.

The above embodiment is only used to illustrate the present invention, not intended to limit the scope thereof. Many modifications of the above embodiment can be made without departing from the spirit of the present invention.

What is claimed is:

1. A toy car structure comprising:

a) a car body including a base seat and at least two movable car doors movable between open and closed positions, each door being acted on by a biasing element urging the door to the closed position;

b) a driving mechanism for moving the toy car, the mechanism including a first power source and a driving gear set;

c) a casing mounted on the base seat and located within the car body, the casing enclosing the first power source;

d) a second power source located within the casing;

e) a rack slidably mounted within the casing such that an end of the rack extends outwardly of the casing, the rack drivingly engaged with the second power source so as to oscillate back and forth along a longitudinal axis;

f) first and second linking members each having a generally L-shaped configuration with a long arm and a short arm, and each being pivotally connected to the base seat at a juncture of the long and short arms, a post on one of the long arms engaging a slot in the other of the long arms and at least one of the long arms connected to the end of the rack such that the oscillating movement of the rack causes the first and second linking members to pivotally oscillate about their respective pivotally connected junctures; and, g) first and second pushing members, each pivotally attached to the base seat at a first end and drivingly connected to the short arm of one of the first and second linking members such that the pivotal oscillating movement of the first and second linking members causes pivotal oscillating movement of the first and second pushing members, each pushing member acting on one of the at least two movable car doors such that pivotal oscillating movement of the pushing members moves the movable car doors between the open and closed positions.

2. The toy car of claim 1 further comprising:

a) a post extending from each of the first and second pushing members; and, b) a resilient member mounted on the short arm of each linking member and engaging the post to impart pivotal movement of the linking member to the associated pushing member.

3. The toy car of claim 1 further comprising:

a) a hood movably attached to the car body so as to be movable between open and closed positions, the hood having a hood pushing member extending therefrom;

b) a second biasing element acting on the hood so as to bias the hood toward the closed position;

c) a driving block slidably mounted on the casing, an end of the driving block contacting a pushing edge on the rack such that oscillation of the rack causes the driving block to oscillate back and forth; and, d) a pushing projection extending from the pushing block in contact with the pushing member of the hood such that oscillation of the driving block moves the hood between the open and closed position.

4. The toy car of claim 3 further comprising:

a) at least one through hole in the car body through which is normally visible a car light;

b) a beam pivotally mounted on the base seat;

c) at least one car light cover body connected to the beam;

d) a guide member slidably located on the base seat, the guide member contacting a driving post extending from the beam; and e) a driving arm extending from the first end of one of the pushing members so as to pivot therewith, the driving arm engaging the guide member such that pivoting movement of the driving arm imparts oscillatory movement to the guide member, which movement causes the beam to pivot, thereby moving the at least one car light cover body between a first position in which it is displaced from the car light and a second position in which it covers the car light.

5. The toy car of claim 1 further comprising:

a) at least one through hole in the car body through which is normally visible a car light;

b) a beam pivotally mounted on the base seat;

c) at least one car light cover body connected to the beam;

d) a guide member slidably located on the base seat, the guide member contacting a driving post extending from the beam; and e) a driving arm extending from the first end of one of the pushing members so as to pivot therewith, the driving arm engaging the guide member such that pivoting movement of the driving arm imparts oscillatory movement to the guide member, which movement causes the beam to pivot, thereby moving the at least one car light cover body between a first position in which it is displaced from the car light and a second position in which it covers the car light.

* * * * *